US008769745B1

(12) United States Patent
Lin

(10) Patent No.: US 8,769,745 B1
(45) Date of Patent: Jul. 8, 2014

(54) PILLOW SUPPORT

(71) Applicant: Ying-Ling Lin, Taoyuan County (TW)

(72) Inventor: Ying-Ling Lin, Taoyuan County (TW)

( * ) Notice: Subject to any disclaimer, the term of this patent is extended or adjusted under 35 U.S.C. 154(b) by 0 days.

(21) Appl. No.: 13/900,531

(22) Filed: May 23, 2013

(51) Int. Cl.
*A47G 9/10* (2006.01)
*A47C 21/00* (2006.01)

(52) U.S. Cl.
USPC ..... 5/638; 5/640; 5/643

(58) Field of Classification Search
USPC ..... 5/636, 638–641, 643; 128/202.18
See application file for complete search history.

(56) References Cited

U.S. PATENT DOCUMENTS

| | | | | | |
|---|---|---|---|---|---|
| 2,305,173 | A * | 12/1942 | Leeb | 5/641 |
| 3,140,497 | A * | 7/1964 | Carswell | 5/638 |
| 4,779,297 | A * | 10/1988 | Sturges | 5/630 |
| 5,970,546 | A * | 10/1999 | Danis | 5/636 |
| 6,151,734 | A * | 11/2000 | Lawrie | 5/640 |
| 2004/0172064 | A1 * | 9/2004 | MacDonald | 606/240 |
| 2010/0205743 | A1 * | 8/2010 | Harges | 5/638 |

* cited by examiner

*Primary Examiner* — Michael Trettel

(57) ABSTRACT

A base for supporting a C-shaped pillow is disclosed. The pillow support includes a C-shaped body and a plurality of partition boards. The C-shaped body has an opening, a central hollow, a top plate and a bottom plate. The partition boards are vertically connected between the top plate and the bottom plate to form a plurality of compartments for receiving sachets.

6 Claims, 4 Drawing Sheets

PILLOW SUPPORT

BACKGROUND OF THE INVENTION

1. Technical Field

The invention relates to pillows, particularly to rigid supports for pillows.

2. Related Art

Please refer to FIG. 1. Most people sleep in a supine posture, i.e., a user's head B is lain on a pillow. A patient with retinal detachment, whose eyes are treated to be filled with a specific gas to avoid redetaching, is not suitable for a supine sleeping posture because it will cause cataract and visual deterioration. Moreover, sleeping with lying face down in a table will press the chest, mouth and nose to make breath forced.

Please refer to FIG. 2. A patient whose eyes were just operated for retinal detachment has to adopt a procumbent sleeping posture for at least two weeks. He or she cannot sleep in a supine posture until the gas in his or her operated eyes is completely absorbed. During the transition period, a C-shaped pillow as shown in FIG. 2 is required. However, such a pillow and sleeping posture will make the patient uncomfortable.

Some patients may use a sleeping frame shown in FIGS. 3 and 4. Such a sleeping frame possesses a vee outline and can lessen pressure against the head, chest and abdomen. However, the supporting point focuses on the patient's chin. The patient's chin will feel uncomfortable when he or she has slept for a long time.

SUMMARY OF THE INVENTION

An object of the invention is to provide a pillow support, which can comfortably support a C-shaped pillow for users who adopt a procumbent sleeping posture.

Another object of the invention is to provide a pillow support, which does not cause pressure to a user's head, chest and abdomen.

Still another object of the invention is to provide a pillow support, which has compartments to receive sachets.

To accomplish the above objects, the pillow support of the invention includes a C-shaped body and a plurality of partition boards. The C-shaped body has an opening, a central hollow, a top plate and a bottom plate. The partition boards are vertically connected between the top plate and the bottom plate to form a plurality of compartments for receiving sachets.

DETAILED DESCRIPTION OF THE DRAWINGS

DETAILED DESCRIPTION OF THE INVENTION

Figure 1:
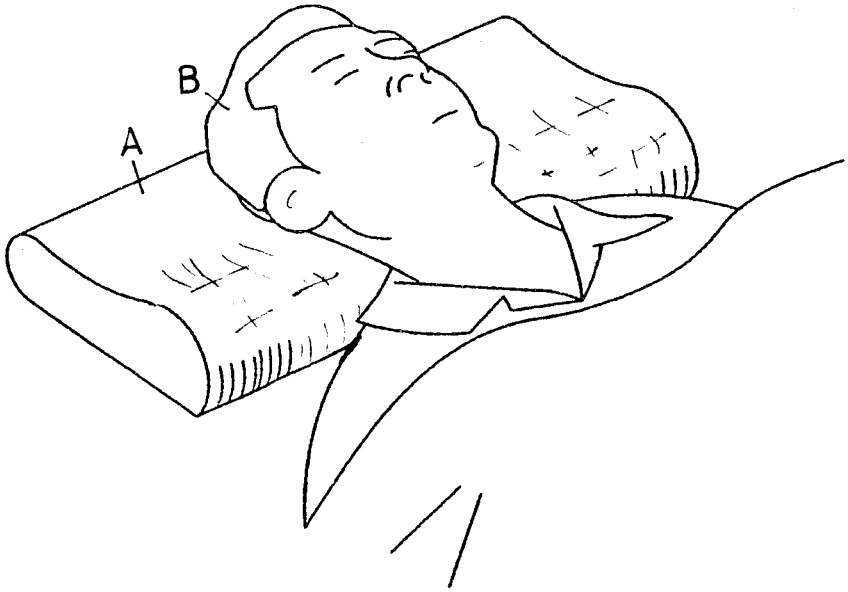
Fig.1 (Prior Art)
FIG. 1 depicts a person who is supinely sleeping.
Figure 2:
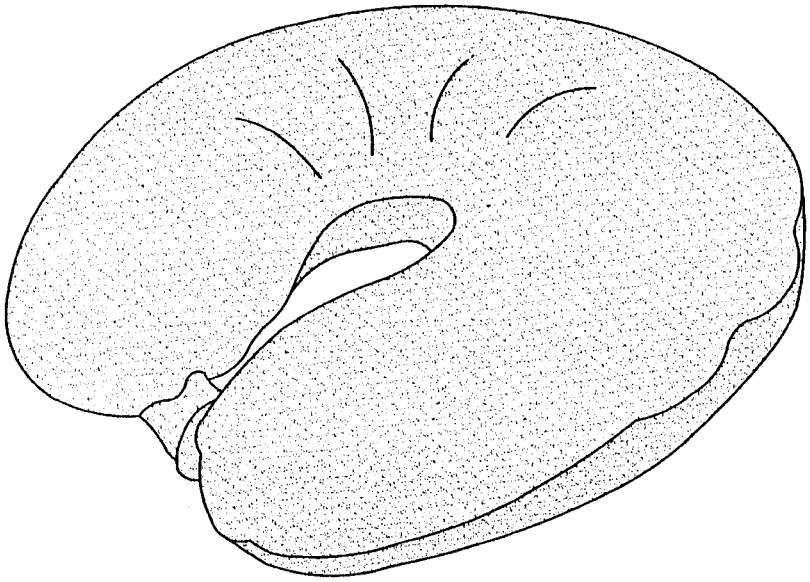
Fig.2 (Prior Art)
FIG. 2 shows a conventional C-shaped pillow.
Figure 3:
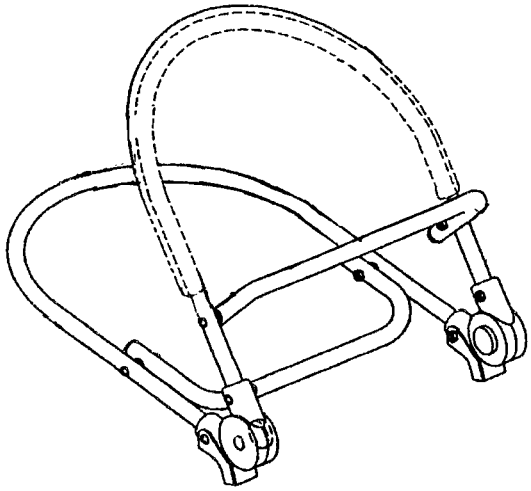
Fig.3 (Prior Art)
FIG. 3 shows a conventional frame for procumbently sleeping.
Figure 4:
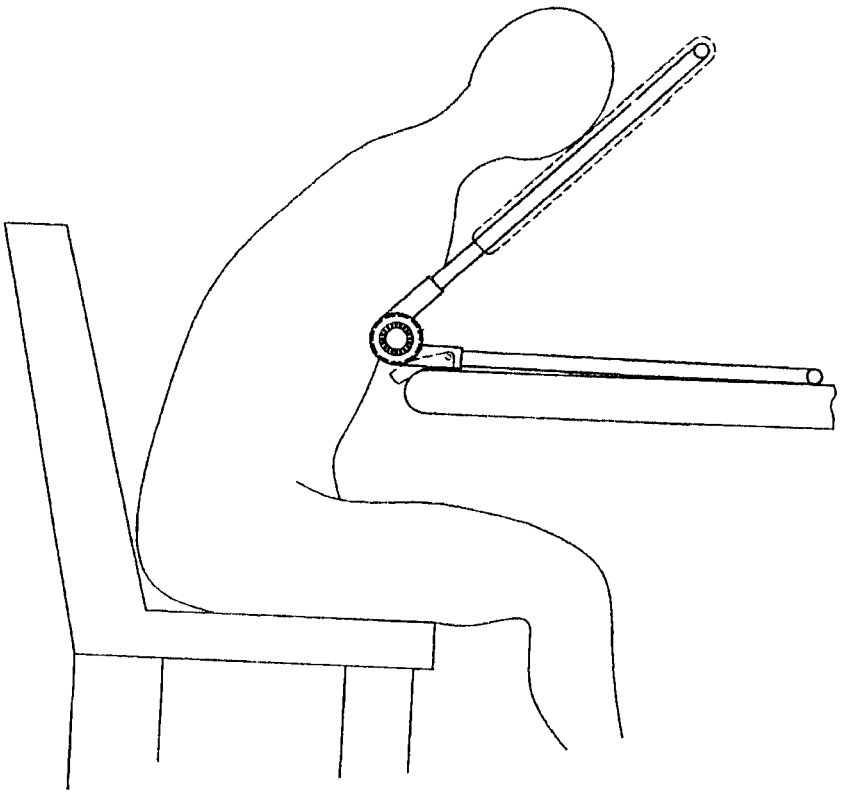
Fig.4 (Prior Art)
FIG. 4 is a schematic view showing the frame of FIG. 3 in use.
Figure 5:
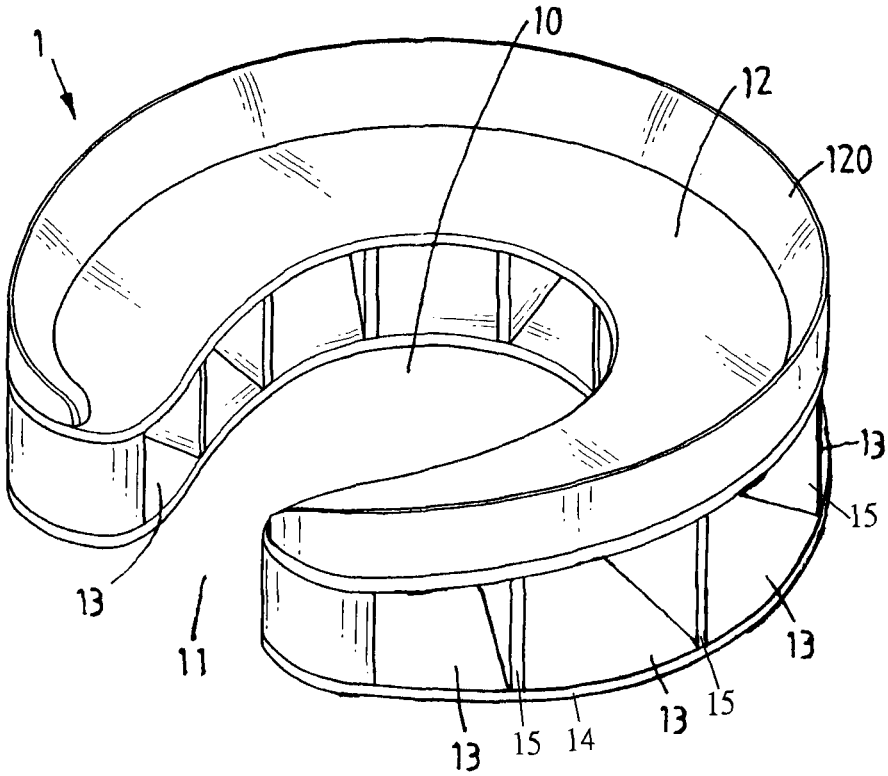
FIG. 5 is a perspective view of the invention.
Figure 6:
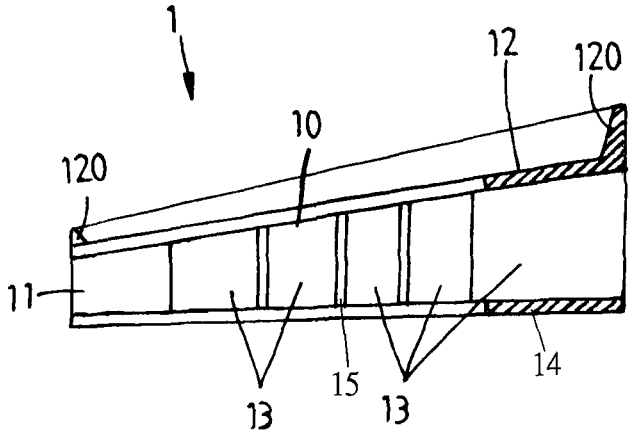
FIG. 6 is a sectional view of the invention.

Please refer to FIGS. 5 and 6. The invention includes a C-shaped body 1. The C-shaped body 1 has a top plate 12, a bottom plate 14, a central hollow 10 and an opening 11. The top plate 12 serves as a placing area for being placed by a C-shaped pillow. A plurality of partition boards 15 are vertically connected between the top plate 12 and the bottom plate 14 to form a plurality of compartments 13 for receiving sachets. The sachets can provide fragrance to make the user feel more comfortable and relaxed. The partition boards are radially arranged so that the compartments 13 are in a radial arrangement.

An outer edge of the top plate 12 is provided with a surrounding wall 120 for holding the C-shaped pillow.

The top plate 12 is inclined toward the opening 11 and is not parallel to the bottom plate 14. This inclined top plate 12 can form a comfortable elevation for users.

Figure 7:
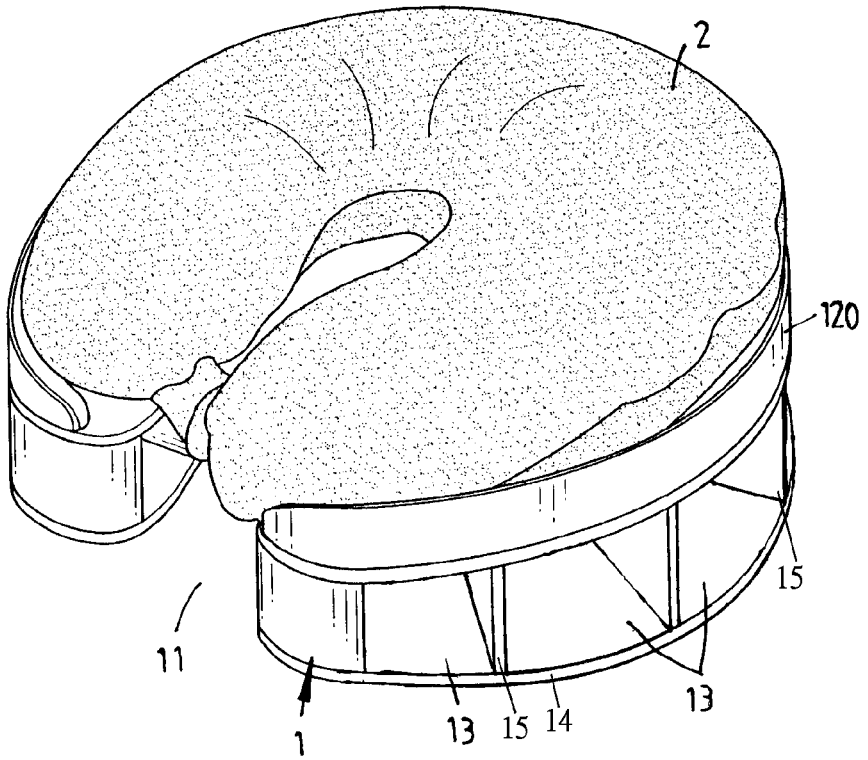
FIG. 7 is a schematic view of the invention with a pillow.
Figure 8:
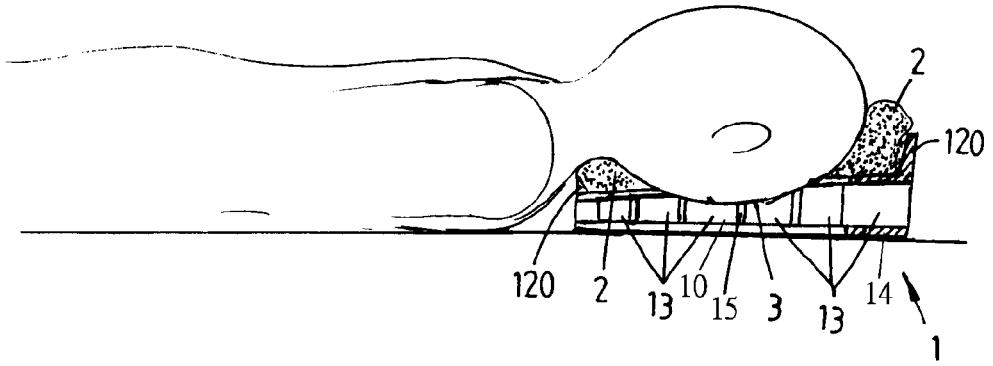
FIG. 8 is a schematic view showing the invention in use.

Please refer to FIGS. 7 and 8. By the arrangement of the surrounding wall 120, a C-shaped pillow 2 can be easily held on the top plate 12. This can make the user breathe smoothly and comfortably when his or her face 3 is lain on the C-shaped pillow 2. Sachets received in the compartments 13 may supply fragrance to make the user feel more comfortable and relaxed. The C-shaped pillow 2 completely attaches the user's face 3, so that it will not cause local pressure.

It will be appreciated by persons skilled in the art that the above embodiment has been described by way of example only and not in any limitative sense, and that various alterations and modifications are possible without departure from the scope of the invention as defined by the appended claims.

What is claimed is:

1. A pillow support comprising:

a C-shaped body having an opening, a central hollow, a top plate and a bottom plate; and a plurality of partition boards, vertically connected between the top plate and the bottom plate to form a plurality of compartments;

wherein the top plate is inclined toward the opening and is not parallel to the bottom plate.

2. The pillow support of claim 1, further comprising a surrounding wall extending from the top plate.

3. The pillow support of claim 2, wherein the surrounding wall is located on an outer edge of the top plate.

4. The pillow support of claim 1, wherein the partition boards are radially arranged.

5. A pillow support comprising:

a C-shaped body having an opening, a central hollow, a top plate and a bottom plate, wherein a surrounding wall extends from the top plate; and a plurality of partition boards, vertically connected between the top plate and the bottom plate to form a plurality of compartments.

6. The pillow support of claim 5, wherein the partition boards are radially arranged.

* * * * *